US009228433B2

(12) United States Patent
Sawyer et al.

(10) Patent No.: US 9,228,433 B2
(45) Date of Patent: Jan. 5, 2016

(54) APPARATUS AND PROCESS FOR WELLBORE CHARACTERIZATION

(75) Inventors: Scott Sawyer, Katy, TX (US); Donovan Balli, Houston, TX (US); Michael J. Tangedahl, Magnolia, TX (US); James Gunnels, Richmond, TX (US); Roger Suter, Katy, TX (US)

(73) Assignee: M-I L.L.C., Houston, TX (US)

( * ) Notice: Subject to any disclaimer, the term of this patent is extended or adjusted under 35 U.S.C. 154(b) by 588 days.

(21) Appl. No.: 13/145,192

(22) PCT Filed: Feb. 9, 2010

(86) PCT No.: PCT/US2010/023624

§ 371 (c)(1),
(2), (4) Date: Jul. 19, 2011

(87) PCT Pub. No.: WO2010/093626

PCT Pub. Date: Aug. 19, 2010

(65) Prior Publication Data

US 2011/0284288 A1 Nov. 24, 2011

Related U.S. Application Data

(60) Provisional application No. 61/241,793, filed on Sep. 11, 2009, provisional application No. 61/151,699, filed on Feb. 11, 2009.

(51) Int. Cl.
*E21B 49/00* (2006.01)

(52) U.S. Cl.
CPC ..... *E21B 49/005* (2013.01); *Y10T 137/0318* (2015.04); *Y10T 137/794* (2015.04)

(58) Field of Classification Search
USPC ..... 73/152.42, 152.04, 19.09, 19.01, 19.1, 73/863, 864.81; 96/174; 175/48, 42, 38, 175/50, 40
See application file for complete search history.

(56) References Cited

U.S. PATENT DOCUMENTS

| | | | | |
|---|---|---|---|---|
| 4,298,572 | A | | 11/1981 | Moffet et al. |
| 4,635,735 | A | | 1/1987 | Crownover |
| 4,765,182 | A | * | 8/1988 | Boone ..... 73/152.04 |
| 4,887,464 | A | | 12/1989 | Tannenbaum et al. |
| 5,730,234 | A | | 3/1998 | Putot |
| 5,812,068 | A | | 9/1998 | Wisler et al. |
| 6,002,985 | A | | 12/1999 | Stephenson |
| 6,012,015 | A | | 1/2000 | Tubel |
| 6,021,377 | A | | 2/2000 | Dubinsky et al. |
| 6,044,325 | A | | 3/2000 | Chakravarthy et al. |

(Continued)

OTHER PUBLICATIONS

Examination Report issued Sep. 15, 2013 in corresponding GCC application No. GC2010-15270 (5 pages).

(Continued)

*Primary Examiner* — David Andrews
*Assistant Examiner* — Ronald Runyan
(74) *Attorney, Agent, or Firm* — Osha Liang LLP

(57) ABSTRACT

An apparatus and a process for wellbore characterization are disclosed, including: separating, in a separation vessel, drilling mud from gas produced during drilling of a wellbore; transporting the separated produced gas from the separation vessel to a downstream process; and measuring at least one of a temperature, a pressure, a mass flow rate, and a volumetric flow rate of the separated produced gas during transport using one or more sensors. Properties of the gas separated from the mud may be used to determine characteristics of a wellbore.

20 Claims, 4 Drawing Sheets

(56) References Cited

U.S. PATENT DOCUMENTS

| | | | | |
|---|---|---|---|---|
| 6,105,689 | A | 8/2000 | McGuire et al. | |
| 6,349,595 | B1 | 2/2002 | Civolani et al. | |
| 6,424,919 | B1 | 7/2002 | Moran et al. | |
| 6,873,267 | B1 * | 3/2005 | Tubel et al. | 340/853.3 |
| 7,071,696 | B2 | 7/2006 | Gambier et al. | |
| 2002/0112888 | A1 * | 8/2002 | Leuchtenberg | 175/48 |
| 2008/0294606 | A1 | 11/2008 | Moran et al. | |

OTHER PUBLICATIONS

Office Action issued Apr. 5, 2013 in corresponding Canadian application No. 2,749,573 (2 pages).

Office Action (w/translation) issued Apr. 23, 2013 in corresponding Eurasian application No. 201171036/(31)(3 pages).

International Search Report issued in PCT/US2010/023624, mailed on Jul. 29, 2010, 4 pages.

Written Opinion issued in PCT/US2010/023624, mailed on Jul. 29, 2010, 5 pages.

Office Action (w/translation) issued Feb. 5, 2013 in corresponding Mexican application No. MX/a/2011/007561 (7 pages).

Weimers, Timothy O., P.E.; Halliburton Energy Services, Inc.; "Produced-Gas Measurement Using Ultrasonic Metering During Underbalanced Operations"; IADC/SPE 108349; Mar. 28-29, 2007 (10 pages).

Office Action (w/translation) issued Dec. 16, 2013 in corresponding Eurasian application No. 201171036/(31) (5 pages).

Examination Report issued Aug. 13, 2014 in corresponding GCC application No. GC2010-15270 (5 pages).

Office Action issued in corresponding Eurasian Application No. 201171036/31 with English translation dated Nov. 19, 2014 (4 pages).

* cited by examiner

APPARATUS AND PROCESS FOR WELLBORE CHARACTERIZATION

BACKGROUND OF THE DISCLOSURE

1. Field of the Disclosure

Embodiments disclosed herein relate generally to systems and processes for characterization of a wellbore. More particularly, embodiments disclosed herein measure properties of gases produced during drilling, in addition to other drilling measurements, to characterize a wellbore. Such characterizations may be performed in real-time, allowing for the optimization of drilling parameters and improvement in drilling performance and the resulting well stability.

2. Background Art

Wellbore drilling, which is used, for example, in petroleum exploration and production, includes rotating a drill bit while applying axial force to the drill bit. The rotation and the axial force are typically provided by equipment at the surface that includes a drilling "rig." The rig includes various devices to lift, rotate, and control segments of drill pipe, which ultimately connect the drill bit to the equipment on the rig. The drill pipe provides a hydraulic passage through which drilling fluid is pumped. The drilling fluid discharges through selected-size orifices in the bit ("jets") for the purposes of cooling the drill bit and lifting rock cuttings out of the wellbore as it is being drilled.

The speed and economy with which a wellbore is drilled, as well as the quality of the hole drilled, depend on a number of factors. These factors include, among others, the mechanical properties of the rocks which are drilled, the diameter and type of the drill bit used, the flow rate of the drilling fluid, and the rotary speed and axial force applied to the drill bit. It is generally the case that for any particular mechanical properties of rocks, a rate at which the drill bit penetrates the rock ("ROP") corresponds to the amount of axial force on and the rotary speed of the drill bit. The rate at which the drill bit wears out is generally related to the ROP. Various methods have been developed to optimize various drilling parameters to achieve various desirable results.

Prior art methods for optimizing values for drilling parameters have focused on rock compressive strength. For example, U.S. Pat. No. 6,349,595, issued to Civolani, el al. ("the '595 patent"), discloses a method of selecting a drill bit design parameter based on the compressive strength of the formation. The compressive strength of the formation may be directly measured by an indentation test performed on drill cuttings in the drilling fluid returns. The method may also be applied to determine the likely optimum drilling parameters such as hydraulic requirements, gauge protection, weight on bit ("WOB"), and the bit rotation rate. The '595 patent is hereby incorporated by reference in its entirety.

U.S. Pat. No. 6,424,919, issued to Moran, et al. ("the '919 patent"), discloses a method of selecting a drill bit design parameter by inputting at least one property of a formation to be drilled into a trained Artificial Neural Network ("ANN"). The '919 patent also discloses that a trained ANN may be used to determine optimum drilling operating parameters for a selected drill bit design in a formation having particular properties. The ANN may be trained using data obtained from laboratory experimentation or from existing wells that have been drilled near the present well, such as an offset well. The '919 patent is hereby incorporated by reference in its entirety.

Several references disclose various methods for using ANNs to solve various drilling, production, and formation evaluation problems. These references include U.S. Pat. No. 6,044,325 issued to Chakravarthy, et al., U.S. Pat. No. 6,002,985 issued to Stephenson, et al., U.S. Pat. No. 6,021,377 issued to Dubinsky, et al., U.S. Pat. No. 5,730,234 issued to Putot, U.S. Pat. No. 6,012,015 issued to Tubel, and U.S. Pat. No. 5,812,068 issued to Wisler, et al.

The data collection and analyses used in the above-described methods for simulating or analytically determining characteristics of a wellbore, while useful analytical and learning tools, often fail to properly characterize a wellbore. What is needed, therefore, are methods and apparatus useful for a more complete and accurate characterization of a wellbore.

SUMMARY OF CLAIMED EMBODIMENTS

In one aspect, embodiments disclosed herein relate to a process for wellbore characterization, the process including: separating, in a separation vessel, drilling mud from gas produced during drilling of a wellbore; transporting the separated produced gas from the separation vessel to a downstream process; and measuring at least one of a temperature, a pressure, a mass flow rate, and a volumetric flow rate of the separated produced gas during transport using one or more sensors. In some embodiments, the properties of the separated gas may be used to determine properties of a wellbore. In other embodiments, the properties of the separated gas may be aggregated with additional sensor data obtained while drilling to determine characteristics of the wellbore.

In another aspect, embodiments disclosed herein relate to a system for characterizing a wellbore, the system including: a separation vessel for separating drilling mud from gas produced during drilling of a wellbore; a fluid conduit for transporting the separated produced gas from the separation vessel to a downstream process; one or more sensors for measuring at least one of a temperature, a pressure, a mass flow rate, and a volumetric flow rate of the separated gas during transport in the fluid conduit.

In some embodiments, the system may also include: a first computer device for storing data collected by the one or more sensors; communication paths for transmitting data from the first computer device in a first computer output format; a translation device for translating the data in the first computer output format to a second computer output format; communication paths for transmitting the translated data to a second computer device.

In other embodiments, the system may also include: at least one sensor for measuring at least one wellbore property; communication paths for transmitting the measured wellbore properties to the second computer device; and a data analysis system for analyzing the at least one wellbore property and the translated data to determine characteristics of the wellbore. A control system may also be used in some embodiments for controlling the drilling based on the determined characteristics.

In another aspect, embodiments disclosed herein relate to a process for measuring carbon emissions during the drilling of a wellbore. The process may include: separating, in a separation vessel, drilling mud from gas produced during drilling of a wellbore; transporting the separated produced gas from the separation vessel to a downstream process; measuring at least one of a temperature, a pressure, a mass flow rate, and a volumetric flow rate of the separated produced gas during transport using one or more sensors; determining at least one of a standard volumetric flow rate and an average molecular weight of the separated produced gas based on the measuring. In some embodiments, the process may also include determining a cumulative amount of the separated produced gas transported over a time period based on at least one of the determined standard volumetric flow rate and the determined average molecular weight.

In another aspect, embodiments disclosed herein relate to a system for measuring carbon emissions during the drilling of a wellbore. The system may include: a separation vessel for separating drilling mud from gas produced during drilling of a wellbore; a fluid conduit for transporting the separated produced gas from the separation vessel to a downstream process; one or more sensors for measuring at least one of a temperature, a pressure, and a volumetric flow rate of the separated gas during transport in the fluid conduit; and a computer device for at least one of transmitting, storing, and analyzing the measurements from the one or more sensors. In some embodiments, the computer device is configured to determine a cumulative amount of the separated produced gas transported through the fluid conduit over a time period based the measurements from the one or more sensors.

Other aspects and advantages of the invention will be apparent from the following description and the appended claims.

DETAILED DESCRIPTION

Embodiments disclosed herein relate generally to systems and processes for characterization of a wellbore. More particularly, embodiments disclosed herein measure properties of gases produced during drilling, in addition to other drilling measurements, to characterize a wellbore. Such characterizations may be performed in real-time, allowing for the optimization of drilling parameters and improvement in drilling performance and the resulting well stability.

When drilling or completing wells in earth formations, various fluids typically are used in the well for a variety of reasons. Common uses for well fluids include: lubrication and cooling of drill bit cutting surfaces while drilling generally or drilling-in (i.e., drilling in a targeted petroliferous formation), transportation of "cuttings" (pieces of formation dislodged by the cutting action of the teeth on a drill bit) to the surface, controlling formation fluid pressure to prevent blowouts, maintaining well stability, suspending solids in the well, minimizing fluid loss into and stabilizing the formation through which the well is being drilled, fracturing the formation in the vicinity of the well, displacing the fluid within the well with another fluid, cleaning the well, testing the well, transmitting hydraulic horsepower to the drill bit, fluid used for emplacing a packer, abandoning the well or preparing the well for abandonment, and otherwise treating the well or the formation.

During drilling, the mud is injected through the center of the drill string to the bit and exits in the annulus between the drill string and the wellbore, fulfilling, in this manner, the cooling and lubrication of the bit, casing of the well, and transporting the drill cuttings to the surface. At the surface, the mud can be separated from the drill cuttings for reuse, and the drill cuttings can be disposed of in an environmentally accepted manner. In addition to transporting drill cuttings to the surface, gases present in various layers of the formation being drilled may also be transported to the surface by the mud. Transport of gases to the surface with the mud is common during underbalanced drilling, but may also be present to some degree during balanced or overbalanced drilling.

Figure 1:
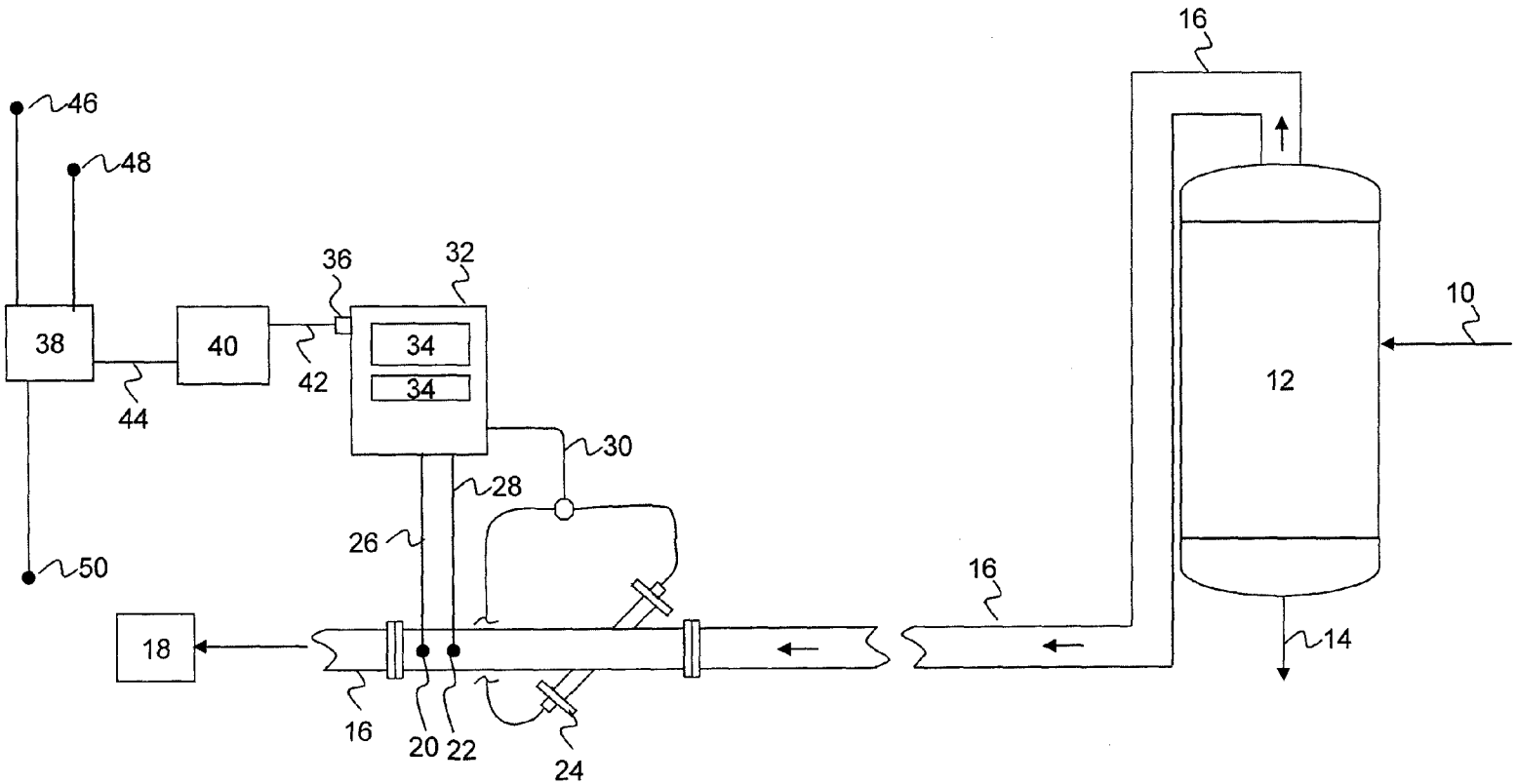
FIG. 1 is a simplified process flow diagram according to embodiments disclosed herein.

Referring now to FIG. 1, a simplified flow diagram of a process for wellbore characterization or carbon emission measurement according to embodiments disclosed herein is illustrated. Mud, including gas produced from the wellbore during drilling, may be fed via flow line 10 to mud/gas separator 12, which may provide sufficient residence time for the mud to degas prior to being recovered and fed via flow line 14 to various downstream processes for preparation of the mud for recycle, where such processes may include shakers, centrifuges, and the like, to separate drill cuttings from the mud and other mud processes as known to one skilled in the art.

The separated gas may be recovered from mud/gas separator 12 via flow line 16. Formations being drilled have varying gas compositions, content (volume), and pressures, and therefore flow line 16 should be adequately sized to account for intermittent flow or surges in the volume of gas flow that may be encountered while drilling. Gas produced during drilling may be forwarded via flow line 16 to various downstream processes 18, which may include gas recovery, such as for sales, gas disposal, such as to a flare or used as a fuel source, or to processes for the conversion of the gas, typically lighter hydrocarbons, to a heavier hydrocarbon.

The flow of gas from the wellbore, as mentioned above, may be intermittent or come in surges with the circulating mud. As such, the properties of the gas produced with the mud flow may be used to determine characteristics of the wellbore being drilled. For example, the gas produced may be indicative of formation type, permeability of the formation, and other characteristics that may be useful in determining optimum drilling operating parameters, for a selected drill bit design in a formation having particular properties.

One or more sensors 20, 22, 24 may be located in flow line 16 to measure the properties of the gas. For example, a thermocouple 20, a pressure transducer 22, and a flow measurement device 24 may be used to measure temperature, pressure, and flow rate, respectively, of the gas during transport from mud/gas separator 12 to downstream process 18 via flow line 16. Flow measurement device 24 may be any type of device for measuring the mass or volumetric flow rate of a gas, including ultrasonic mass measurement devices, such as a UBD Gas Flow Rate Meter System, a gas mass ultrasonic flow meter, such as a DIGITALFLOW GF 868 Panametrics meter, available from GE Industrial Sensing, inertial flow meters, Coriolis mass flow meters, volumetric flow meters, and the like.

Transmission wires 26, 28, 30 may be used to transmit data from measuring devices 20, 22, 24 to a first computer device 32, which may be used to log and store the data, such as at given time intervals.

First computer device 32 may include programming for determining additional properties of the gas. For example, the gas flow rate, at the measured temperature and pressure, may be converted to a standard volumetric flow rate, thus providing for a value suitable for comparison (as similar gas flow rates that are measured at different temperatures and/or pressure are not indicative similar properties, it is preferred to compare volumetric or mass flow rates at a given standard condition) Additionally, first computer device 32 may include programming to determine the average molecular weight of the gas. Determination of average molecular weights, standard mass flow rates and/or volumetric flow rates, or other properties of the gas may be performed, for example, using ideal gas laws or more complex thermodynamic relationships, including variables such as temperature, pressure, mass or volumetric flow, and other variables as may be measured, for the calculation or estimation of gas properties. Variables that may be measured, determined, or logged by first computer device 32 may include one or more of flow velocity, volumetric flow rate, totalized volume flow, total flow measurement time, mass flow, totalized mass flow, gas temperature, gas pressure, average molecular weight, standard volumetric flow, actual volumetric flow, gas compressibility factor, sound speed of the fluid, Reynolds number, and instantaneous velocity, as well as various signal quality measurements, including gain settings, signal quality, signal strength, and signal peaks, among others.

First computer device 32 may also include local readout and control panels 34 for interfacing with first computer device 32 and locally or remotely reviewing the sensor data. First computer device 32 may also include programming and transmission ports 36 for export of the logged data. For example, it may be desired to continuously or intermittently transmit logged data from first computer device 32 to a second computer device 38, where further analyses of the data logged and transmitted may be performed, such as the aforementioned wellbore characterization.

Sensor manufacturers generally provide the sensors and associated devices, such as first computer device 32, where the first computer device is programmed to transmit the logged data in a given output format, such as a text based format having particular log characteristics, headers, carriage returns, start point indicators, end point indicators, and the like, or a binary format including data packets comprising start and end indicators, checksums, and the like.

Analysis of the data using second computer device 38 may be performed on the data as transmitted, in the first output format. Second computer device 38, however, may require a different format for the data than is provided by first computer device 32. In such an instance, it may be necessary to translate the data output from the first computer device to a second computer output format. Translation of the data, for example, may be performed using a translation device 40 intermediate the first and second computer devices 32, 38. Data may be transmitted in a first computer output format via transmission line 42 from first computer device 32 to translation device 40, which may also be used to log and store the data. Translation device 40 may then convert the data from the first computer output format to a second computer output format in which the data may be transmitted via transmission line 44 to second computer device 38. Second computer device 38 may then analyze the measured gas sensor data and the determined gas properties to determine characteristics of the wellbore being drilled.

In some embodiments, the translator may convert the data in the first output format to a Wellsite Information Transfer Standard (WITS) format or a Wellsite Information Transfer Standard Markup Language (WITSML) format. Other transfer standards and proprietary data formats may also be used without deviating from the scope of embodiments disclosed herein, an example of which may include General Electric's IDM protocol.

As an example of data translation using translation device 40, data from a first computer device may be sent in a format including header information and measured or determined data, such as illustrated below.

| | | | |
|---|---|---|---|
| Data Transfer Name Header Line 1 | | | |
| Data Transfer Name Header Line 2 | | | |
| Data Transfer Name Header Line 3 | | | |
| Start Date | Date | | |
| Start Time | Time | | |
| | Variable 1 | Variable 2 | Variable 3 |
| HH:MM:SS | Variable 1 units | Variable 2 units | Variable 3 units |
| Time stamp | data output | data output | data output |

The header, which is herein considered to include all except the last line (the data line) of the above output, may be included for each data timestamp or may be intermittently transmitted, depending upon the transmission protocol of first computer device 32. For example, first computer device 32 may transmit a header followed by a data line, wait for the configured time interval and then send another data line, wait for the configured time interval and then send another data line, etc. Occasionally, first computer device 32 may transmit another header before continuing with the data lines.

As the translator receives data from the meter, the header may be ignored by the translator as it does not fit the format expected. The translator may then convert the data line to the desired second computer output format. For example, the above data may be transferred into a desired format, such as a WITS output format, as illustrated below.

```
&&
AABBCCC.CC
LLMMNNN.NN
XXYYZZZ.ZZ
!!
```

The WITS format may start with two ampersands, a carriage return, and a line feed. Each line contains one WITS item from a WITS record, and the data is tagged with the record number and the item number, then the data value follows. The data tag, for instance, may be four digits (AABB, LLMM, XXYY), where the first two are the record and the remainder of the digits are the item. The rest of the line (CCC.CC, NNN.NN, ZZZ.ZZ) is the value. Each line ends with a carriage return-line feed pair. After all the values are sent, the packet ends with a line of two exclamation points followed by a carriage return and line feed.

For example, a first computer output including volumetric flow rate, temperature, and pressure may include a header and a data line as follows:

| | | | |
|---|---|---|---|
| Data Transfer Name Header Line 1 | | | |
| Data Transfer Name Header Line 2 | | | |
| Data Transfer Name Header Line 3 | | | |
| Start Date | Date | | |
| Start Time | Time | | |
| | Volumetric Flow | Temperature | Pressure |
| HH:MM:SS | Rate $m^3/s$ | ° C. | kPa |
| 07:49:11 A | 11.52 | 32.10 | 13.26 |

The translation device, ignoring the header, may then output the above data as follows.

```
&&
014111.52
014232.10
014313.26
!!
```

In the above, 01 is the record number, where WITS may define record 1 as general time-based data and 41, 42, and 43 are the item numbers. The values are 11.52, 32.10, and 13.26. When transmitting the WITS packet, the translator uses the three buffered values along with the tags 0141, 0142, and 0143 to create the packet. It sends the lines of ampersands, each data value, and then the line of exclamation marks.

While illustrated as translating an input of three variables, translation devices according to embodiments disclosed herein may be used to translate any number of output variables into the desired output format. For example, four, five, six, seven, ten, twenty, thirty, or more variables may be transmitted from the first computer device 32, translated as described above, and transmitted to the second computer device 38. The data output from first computer device 32 may depend upon the analyses being performed and the data input required for the associated wellbore characterization.

In some embodiments, as mentioned above, data may be stored or logged in the translator device, such as to prevent loss of data due to a temporary interruption in transmissions. The stored or logged data may be in the communication format of either the first or second computers, or may be in a format different from both.

Figure 2:
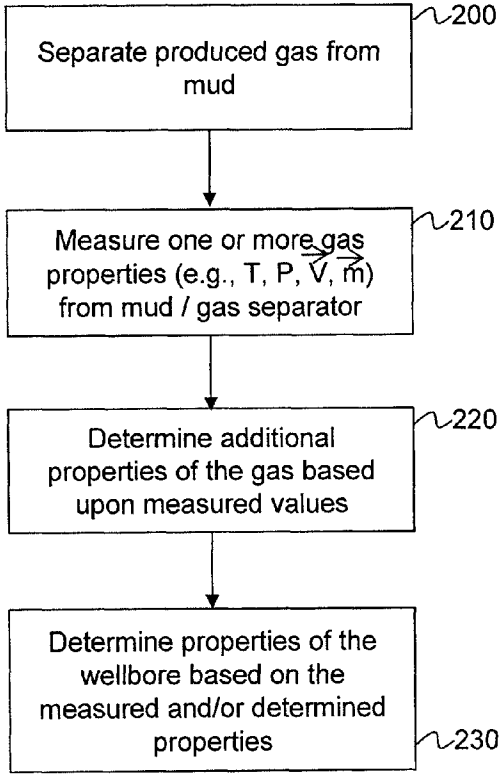
FIG. 2 illustrates a process for wellbore characterization according to embodiments disclosed herein.

Referring now to FIG. 2, a method for characterizing a wellbore according to embodiments disclosed herein is illustrated. In step 200, the gases produced while drilling are separated from the drilling fluid or mud. In step 210, various properties of the separated gas are measured using one or more sensors. Optionally, additional properties of the gas may be determined based upon the values for the measured properties in step 220. In step 230, wellbore characteristics may be determined based on the measured and/or determined values obtained from the one or more sensors measuring properties of the separated gas.

Referring again to FIG. 1, analyses of the gas sensor data alone, as described above, may provide useful data for wellbore characterization. However, it may be desired to aggregate the data from the gas analyses with other data obtained during the drilling operation, such as described in, for example, U.S. Patent Application Publication No. 20080294606, assigned to Smith International, Inc., and incorporated herein by reference. Data to be aggregated with the gas sensor data may include variables such as time, depth, rate of penetration (ROP), wellbore pressure, casing pressure, temperature, and rotational speed of the drill bit in revolutions per minute (RPM), or other variables as may be available or required for the desired characterization of the wellbore. For example, data from one or more additional wellbore sensors 46, 48, 50. The aggregated data may then be analyzed to determine various properties or characteristics of the wellbore.

Figure 3:
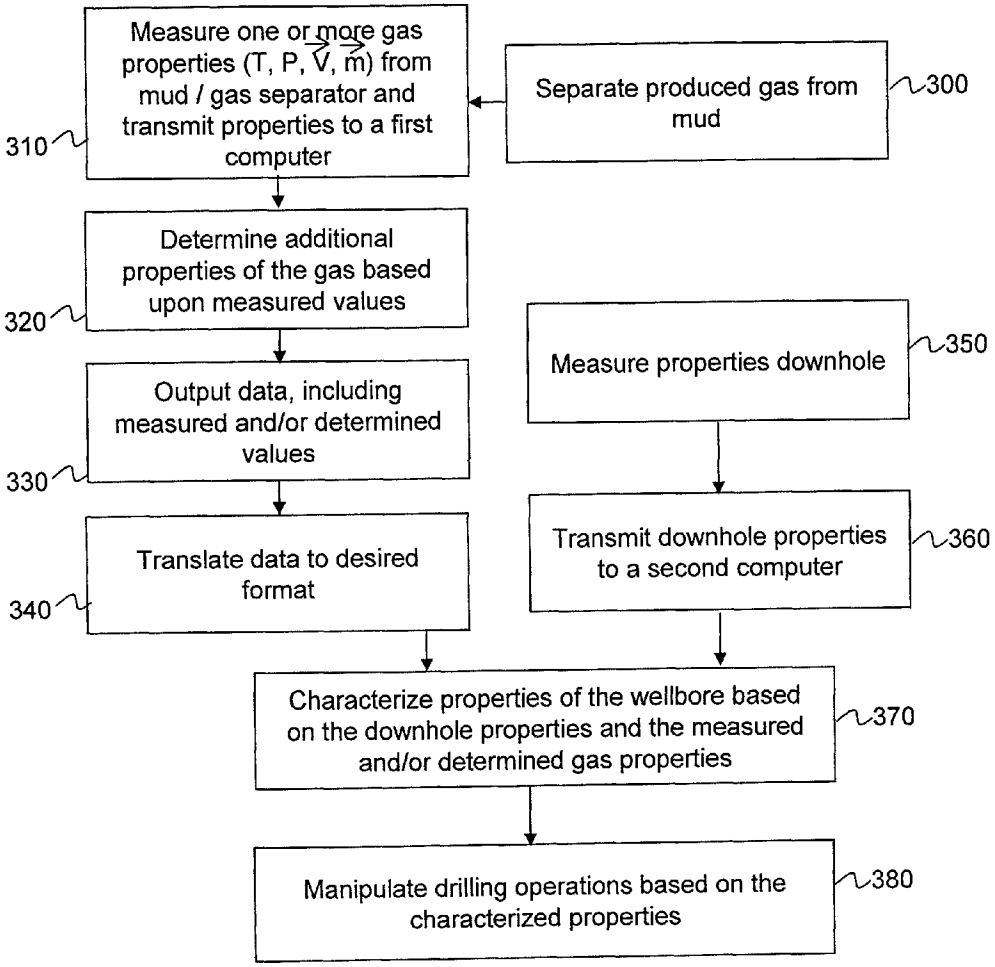
FIG. 3 illustrates a process for wellbore characterization according to embodiments disclosed herein.

Referring now to FIG. 3, a method for characterizing a wellbore according to embodiments disclosed herein is illustrated. In step 300, the gases produced while drilling are separated from the drilling fluid or mud. In step 310, various properties of the separated gas are measured using one or more sensors, where the data is then transmitted to a first computer device for logging of the data. Optionally, additional properties of the gas may be determined based upon the values for the measured properties in step 320, where the additional determined properties may be logged. In step 330, measured sensor data and/or determined properties may be transmitted in a first output format from the first computer device to a translation device for conversion of the data into a second output format.

In step 350, concurrently with the measurement of the separated gas properties, such as in step 310, additional sensors on the wellbore may be used to measure various wellbore properties or drilling parameters, as described above. The additional sensor data may then be transmitted to the second computer in step 360. If necessary, the additional sensor data may additionally be translated into the desired format for use in the second computer.

In step 370, data transmitted in steps 340 and 360 may be aggregated and analyzed to characterize a wellbore. The wellbore may be characterized, for example, using each of measured data from the separated gas sensor, gas properties determined from the measured data, and measured and/or determined data from the one or more additional sensors.

In step 380, the wellbore characteristics determined in step 370 may be used to manipulate drilling operations. For example, when the analyses and wellbore characterization in step 370 are performed in real time, concurrent with drilling, drilling operations may be controlled, manipulated, and/or optimized based upon the results of the wellbore characterization in step 370. Wellbore characteristics determined in step 370 may also be useful for training or other purposes to enhance future and current drilling operations.

In addition to or independent from wellbore characterization, systems for measuring temperature, pressure, and flow rates of a separated gas during drilling may also be used to determine the total amount of carbon emissions generated as a result of the drilling process. As an example, one of the current methods for determining carbon emissions during drilling, underbalanced or otherwise, is to observe a flare visually and to estimate, based on flare height and time of the burn, the amount of gas flowing from the wellbore through the flare system. As an alternative to these manual estimates, the systems and apparatus described herein may be used to accurately measure the carbon emissions produced during the drilling of a wellbore.

Figure 4:
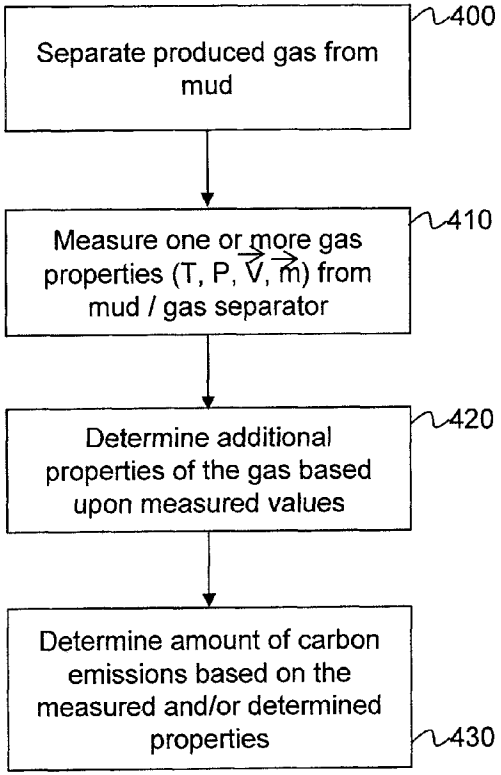
FIG. 4 illustrates a process for measuring carbon emissions during drilling according to embodiments disclosed herein.

Referring now to FIG. 4, a process for measuring carbon emissions during the drilling of a wellbore according to embodiments disclosed herein is illustrated. In step 400, the gases produced while drilling are separated from the drilling fluid or mud. In step 410, various properties of the separated gas are measured using one or more sensors. Optionally, additional properties of the gas may be determined based upon the values for the measured properties in step 420, such as average molecular weight and standard volumetric flow rate, among others. In step 430, a cumulative amount of the separated produced gas transported over a given time period may be determined based on the measured and/or determined values obtained from the one or more sensors measuring properties of the separated gas.

Figure 5:
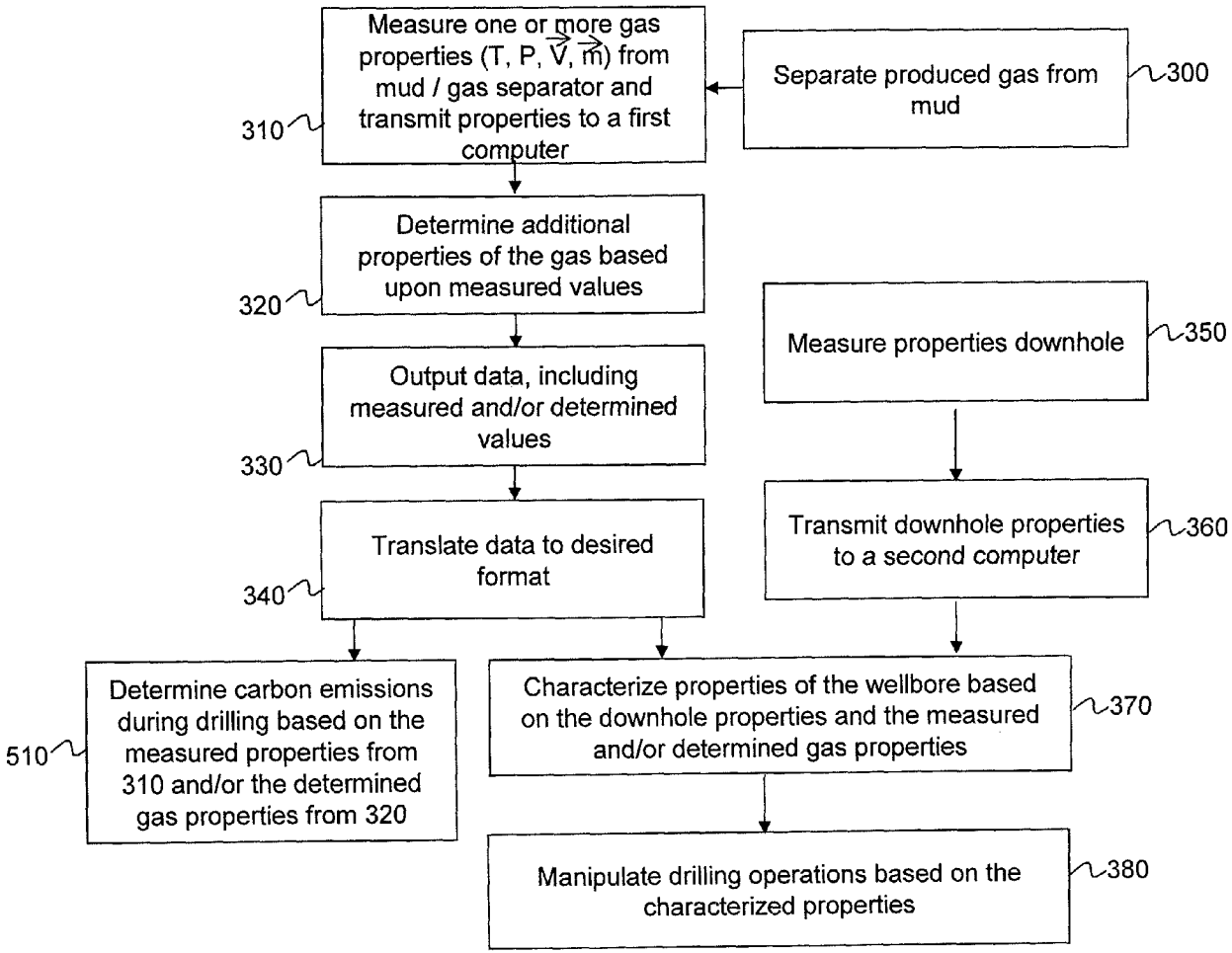
FIG. 5 illustrates a process for wellbore characterization and measuring carbon emissions during drilling according to embodiments disclosed herein.

Referring now to FIG. 5, a combined process for characterizing a wellbore and measuring emissions is illustrated. The process steps are as described with respect to FIG. 3 above, with the added step 510 for determining carbon emissions during drilling based on the measured properties from step 310 and/or the determined gas properties from step 320.

As mentioned above, flow measurement devices useful in embodiments disclosed herein may be any type of device for measuring the flow rate of a gas, including ultrasonic mass measurement devices, such as a UBD Gas Flow Rate Meter System, a gas mass ultrasonic flow meter, such as a DIGITALFLOW GF 868 Panametrics meter, available from GE Industrial Sensing, inertial flow meters, coriolis flow meters, volumetric flow meters, and the like.

The flow rate of gas from a wellbore during drilling may vary widely, and may depend upon the particulars of the stratum being drilled. When drilling strata with little or no gas, the flow rate of gas may be very small; when drilling other strata, the flow rate of gas may be relatively high.

Accordingly, flow measuring devices useful in embodiments disclosed herein may be used to measure a flow velocity in the range from about 0.05 ft/s to about 500 ft/s in some embodiments; from about 0.1 ft/s to about 400 ft/s in other embodiments; from about 0.175 ft/s to about 275 or 300 ft/s in other embodiments; and from about 1 ft/s to about 275 or 300 ft/s in yet other embodiments. For a given range for the flow measuring device, the accuracy of the velocity measurement may be about +/−10% in some embodiments; in the range of +/−1 to 10% in other embodiments; in the range of +/−2 to 5% in other embodiments; and within an accuracy of about +/−1 ft/s over the range of flow given in yet other embodiments. Similarly, temperature measurement devices and pressure measurement devices may have a selected range and accuracy as known to those skilled in the art. Selection of a suitable range and desired accuracy may depend upon the use of the flow measuring device, including characterization of a wellbore, measurement of carbon emissions, or a combination thereof.

The compounds passing by or through the flow measurement devices and related equipment used (pressure measuring devices, temperature measuring devices, etc.), may also vary as based on the stratum and upstream separations, including any upsets that may allow carryover of liquids and/or solids. Further, the flow measurement devices and related equipment must be able to withstand the rigors of the drilling environment, including meeting electrical codes, withstanding vibrations, withstanding corrosive environments internal and external to the device, and other variables as known to one skilled in the art. Thus, flow measurement devices and related equipment useful in embodiments disclosed herein should be robust, i.e., able to maintain measurement quality and accuracy while meeting the environmental and operating demands imposed by the drilling process and the regulations for use of such devices.

As described above, embodiments disclosed herein advantageously measure properties of gasses produced during drilling and separated from the drilling mud for characterization of a wellbore or measurement of carbon emissions. In some embodiments, the properties of the gases may be combined with additional sensor data to enhance the wellbore characterization over the analyses using the additional sensor data alone. In addition to enhancing wellbore characterizations, gas sensors according to embodiments disclosed herein may advantageously be used for calculating the amount of gas produced, transported, or disposed, such as to account for all carbon emissions. Additionally, systems and processes according to embodiments disclosed herein may provide an accurate assessment of emissions during the drilling process, allowing an operator to accurately report emissions to various governmental agencies as may be required in various jurisdictions. Such systems may also provide a means for an operator to further optimize the drilling process with respect to drilling speed and total emissions.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A process for wellbore characterization, the process comprising:

separating, in a separation vessel, drilling mud from gas produced during drilling of a wellbore;

transporting the separated produced gas from the separation vessel to a downstream process;

measuring at least one of a temperature and a pressure of only the separated produced gas during transport using one or wore sensors;

measuring at least one of a mass flow rate and a volumetric flow rate of only the separated produced as during transport using one or more ultrasonic sensors;

determining at least one of a standard volumetric flow rate and an average molecular weight of the separated produced gas based on the measuring; and determining properties of the well bore based on the determined standard volumetric flow rate or the determined average molecular weight.

2. The process of claim 1, wherein measuring temperature uses a thermocouple and measuring pressure uses a pressure transducer.

3. The process of claim 1, further comprising determining a cumulative amount of the separated produced gas transported over a time period based on at least one of the determined standard volumetric, flow rate and the determined average molecular weight.

4. The process of claim 1, further comprising:

storing data from the measuring of the separated produced gas in a first computer device;

transmitting the data from the first computer device in a first computer output format, translating the data in the first computer output format to a second computer output format using a translation device; and transmitting the translated data to a second computer device.

5. The process of claim 4, wherein the first computer output format is an DM protocol.

6. The process of claim 4, further comprising:

measuring at least one wellbore property using at least one sensor located within the wellbore, transmitting the wellbore measurements to the second computer; and determining characteristics of the wellbore using each of the wellbore data and the translated data.

7. The process of claim 6, wherein the second computer output format is at least one of an IDM protocol, a WITS data transfer standard and a WITSML data transfer standard.

8. The process of claim 7, further comprising controlling the drilling based on the determined characteristics.

9. A system for characterizing properties of a wellbore, the system comprising:

a separation vessel configured to separate drilling mud from gas produced during drilling of a wellbore;

a fluid conduit configured to transport the separated produced gas from the separation vessel to a downstream process;

one or more ultrasonic sensors configured to measure at least one of a mass flow rate and a volumetric flow rate of only the separated gas during transport in the fluid conduit; and a data analysis system configured to analyze the at least one measured property to determine characteristics of the wellbore.

10. The system of claim 9, further comprising a thermocouple to measure temperature and a pressure transducer to measure pressure.

11. The system of claim 9, further comprising:

a first computer device configured to store data collected by the sensor;

communication paths configured to transmit data from the first computer device in a first computer output format;

a translation device configured to translate the data in the first computer output format to a second computer output format; and communication paths configured to transmit the translated data to a second computer device.

12. The system of claim 11, wherein the first computer output format is an IDM protocol.

13. The system of claim 11, further comprising:

at least one sensor configured to measure at least one wellbore property;

communication paths configured to transmit the measured wellbore properties to the second computer device; and wherein the data analysis system is configured to analyze the at least one wellbore property and the translated data to determine characteristics of the wellbore.

14. The system of claim 13, wherein the data analysis system is configured to determine a cumulative amount of the separated produced gas transported through the fluid conduit over a given time period based on the measurements from the one or more sensors.

15. The system of claim 11, wherein the second output format is in at least one of a WITS data transfer standard and a WITSML data transfer standard.

16. A process for measuring carbon emissions during the drilling of a wellbore, the process comprising:

separating, in a separation vessel, drilling mud from gas produced during drilling of wellbore;

transporting the separated produced gas from the separation vessel to a downstream process;

measuring at least one of a temperature and a pressure of only the separated produced gas during transport using a sensor;

measuring at least one of a mass flow rate and a volumetric flow rate of only the separated produced gas during transport using an ultrasonic sensor;

determining at least one of a standard volumetric how rate, a carbon composition, and an average molecular weight of only the separated produced gas based on the measuring; and determining properties of the well bore based on the determined standard volumetric flow rate, the determined carbon composition, or the determined average molecular weight.

17. The process of claim 16, wherein measuring temperature uses a thermocouple, and measuring pressure uses a pressure transducer.

18. The process of claim 16, further comprising determining a cumulative amount of the separated produced gas transported over a time period based on at least one of the determined standard volumetric flow rate and the determined average molecular weight.

19. A system for measuring carbon emissions during the drilling of a wellbore, the process comprising:

a separation vessel configured to separate drilling mud from gas produced during drilling of a wellbore;

a fluid conduit configured to transport the separated produced gas from the separation vessel to a downstream process;

one or more sensors configured to measure at least one of a temperature and a pressure, of only the separated gas during transport in the fluid conduit;

one or more ultrasonic sensors configured to measure at least one of a mass flow rate and a volumetric flow rate of only the separated gas during transport in the fluid conduit;

a data analysis system configured to analyze the at least one measured property to determine characteristics of the wellbore; and a computer device configured to transmit, store, or analyze the measurements from the one or more sensors.

20. The system of claim 19, wherein the computer device is configured to determine a cumulative amount of the separated produced gas transported through the fluid conduit over a time period based on the measurements from the one or more sensors.

* * * * *